US008948649B2

(12) United States Patent
McCoy et al.

(10) Patent No.: US 8,948,649 B2
(45) Date of Patent: Feb. 3, 2015

(54) SEALING MEMBER HAVING INTERNAL LUBRICANT ADDITIVES

(75) Inventors: Jody Evan McCoy, Stanton, KY (US); Gregory Keith Norris, Lexington, KY (US); St. Claire Devon Skepple, Richmond, KY (US); Robert Francis Soto, Lexington, KY (US); Donald Wayne Stafford, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 277 days.

(21) Appl. No.: 13/565,906

(22) Filed: Aug. 3, 2012

(65) Prior Publication Data

US 2013/0259514 A1 Oct. 3, 2013

Related U.S. Application Data

(60) Provisional application No. 61/616,751, filed on Mar. 28, 2012.

(51) Int. Cl.
*G03G 15/08* (2006.01)

(52) U.S. Cl.
USPC ..... 399/103

(58) Field of Classification Search
CPC ..... G03G 15/0817
USPC ..... 399/103, 105, 102
See application file for complete search history.

(56) References Cited

U.S. PATENT DOCUMENTS

| | | | |
|---|---|---|---|
| 6,487,383 | B2 | 11/2002 | Buchanan et al. |
| 6,985,683 | B2 | 1/2006 | Foster et al. |
| 7,561,820 | B2 | 7/2009 | Gayne et al. |
| 7,623,807 | B2 | 11/2009 | Carter, II et al. |
| 7,627,265 | B2 | 12/2009 | Gayne et al. |
| 8,099,012 | B2 | 1/2012 | Askren et al. |
| 8,116,657 | B2 | 2/2012 | Kant et al. |
| 8,644,725 | B2 | 2/2014 | Brown et al. |
| 2004/0001727 | A1 * | 1/2004 | Akutsu |
| 2007/0034099 | A1 | 2/2007 | Gayne et al. |

* cited by examiner

*Primary Examiner* — Susan Lee
(74) *Attorney, Agent, or Firm* — Justin M Tromp

(57) ABSTRACT

A sealing member for use in an electrophotographic image forming device according to one example embodiment includes a molded body formed of an elastomer material and internal lubricant additives. The lubricant additives include at least about 20% by weight of the molded body. The lubricant additives include a wet lubricant, a dry lubricant and rounded beads.

16 Claims, 6 Drawing Sheets

SEALING MEMBER HAVING INTERNAL LUBRICANT ADDITIVES

CROSS REFERENCES TO RELATED APPLICATIONS

This application claims priority to U.S. Provisional Patent Application Ser. No. 61/616,751, filed Mar. 28, 2012, entitled "A Sealing Member Having Internal Lubricant Additives," the content of which is hereby incorporated by reference in its entirety.

BACKGROUND

1. Field of the Disclosure

The present disclosure relates generally to electrophotographic printers and more particularly to a sealing member having internal lubricant additives for use in an electrophotographic printer.

2. Description of the Related Art

Various seals are used in electrophotographic printers to prevent toner from leaking between the printer's components. For example, toner leakage may occur from the gaps between a developer roll that supplies toner to a photoconductive drum of the electrophotographic printer, a doctor blade in contact with the developer roll and the housing of a replaceable unit that holds the developer roll and the doctor blade. Seals may be provided to effectively close the gaps between these components to prevent toner leakage. For example, a J-shaped seal may be used at each axial end of the developer roll to prevent toner from leaking out of the junction between the developer roll, the doctor blade and the housing of the replaceable unit. The J-shaped seals may comprise a molded (e.g., injection molded or compression molded) part made of a polymeric based elastomeric material.

The J-shaped seal may also include a lubricant additive internal to its composition that reduces the friction between the seal and the developer roll. For example, prior seals included in the elastomeric material about 1% silicone oil and about 1% polytetrafluoroethylene (TEFLON® available from E.I. du Pont de Nemours and Company (DuPont™)) by weight of the seal. However, as print speeds increase (e.g., greater than 40 pages per minute), the friction between the J-shaped seal and the developer roll increases. In some cases, the increased friction may increase the wear on the seal reducing the seal's useful life. Further, the increased friction may generate heat sufficient to prematurely melt the toner resulting in print defects and toner leakage. As print speeds increase and longer life components are desired, an internal lubricant that reduces frictional heating, prevents thermal failures and extends the life of the seal at higher print speeds is desired. Some prior seals also included an externally applied silicone wax but this external lubricant gradually wears away over the life of the seal. Attempts to reduce frictional heating by reducing the force between the J-shaped seals and the developer roll by using softer materials or dimensional changes have failed because the lower force is insufficient to seal the toner.

SUMMARY

A sealing member for use in an electrophotographic image forming device according to a first example embodiment includes a molded body formed of an elastomer material and internal lubricant additives. The lubricant additives include at least about 20% by weight of the molded body. The lubricant additives include a wet lubricant, a dry lubricant and rounded beads.

A sealing member for use in an electrophotographic image forming device according to a second example embodiment includes a molded body formed of an elastomer material and internal lubricant additives. The lubricant additives include at least about 15% tungsten disulfide by weight of the molded body, at least about 5% silicone oil by weight of the molded body and at least about 3% glass beads by weight of the molded body.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
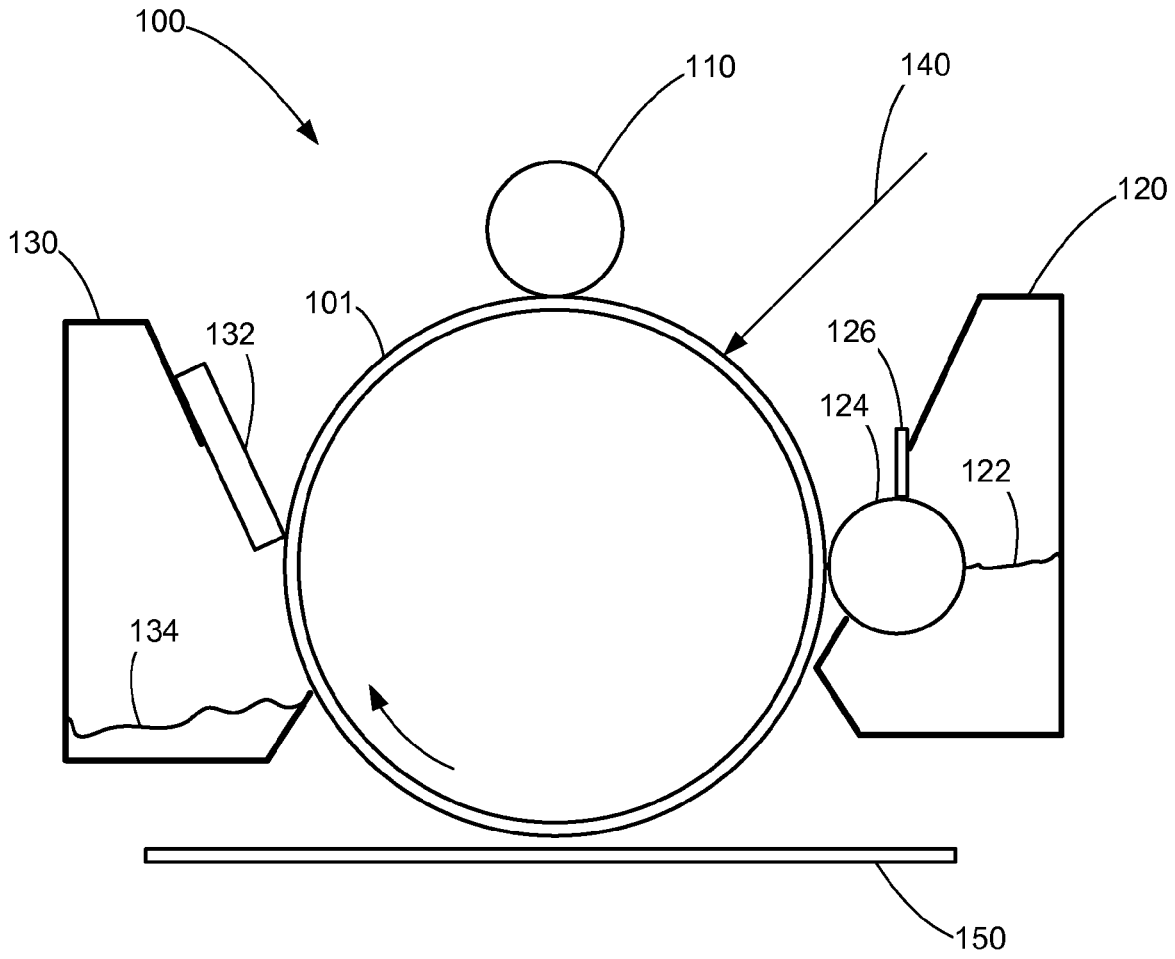
FIG. 1 is a schematic view of an electrophotographic image forming device according to one example embodiment.

FIG. 1 illustrates a schematic representation of an example electrophotographic image forming device 100. Image forming device 100 includes a photoconductive drum 101, a charge roll 110, a developer unit 120, and a cleaner unit 130. The electrophotographic printing process is well known in the art and, therefore, is described briefly herein. During a print operation, charge roll 110 charges the surface of photoconductive drum 101. The charged surface of photoconductive drum 101 is then selectively exposed to a laser light source 140 to form an electrostatic latent image on photoconductive drum 101 corresponding to the image being printed. Charged toner from developer unit 120 is picked up by the latent image on photoconductive drum 101 creating a toned image.

Developer unit 120 includes a toner sump 122 having toner particles stored therein and a developer roll 124 that supplies toner from toner sump 122 to photoconductive drum 101. Developer roll 124 is electrically charged and electrostatically attracts the toner particles from toner sump 122. A doctor blade 126 disposed along developer roll 124 provides a substantially uniform layer of toner on developer roll 124 for subsequent transfer to photoconductive drum 101. As developer roll 124 and photoconductive drum 101 rotate, toner particles are electrostatically transferred from developer roll 124 to the latent image on photoconductive drum 101 forming a toned image on the surface of photoconductive drum 101. In one embodiment, developer roll 124 and photoconductive drum 101 rotate in opposite rotational directions such that their adjacent surfaces move in the same direction to facilitate the transfer of toner from developer roll 124 to photoconductive drum 101. A toner adder roll (not shown) may also be provided to supply toner from toner sump 122 to developer roll 124. Further, one or more agitators (not shown) may be provided in toner sump 122 to distribute the toner therein and to break up any clumped toner.

The toned image is then transferred from photoconductive drum 101 to print media 150 (e.g., paper) either directly by photoconductive drum 101 or indirectly by an intermediate transfer member. A fusing unit (not shown) fuses the toner to print media 150. A cleaning blade 132 (or cleaning roll) of cleaner unit 130 removes any residual toner adhering to photoconductive drum 101 after the toner is transferred to print media 150. Waste toner from cleaning blade 132 is held in a waste toner sump 134 in cleaning unit 130. The cleaned surface of photoconductive drum 101 is then ready to be charged again and exposed to laser light source 140 to continue the printing cycle.

The components of image forming device 100 are replaceable as desired. For example, in one embodiment, developer unit 120 is housed in a replaceable unit with photoconductive drum 101, cleaner unit 130 and the main toner supply of image forming device 100. In another embodiment, developer unit 120 is provided with photoconductive drum 101 and cleaner unit 130 in a first replaceable unit while the main toner supply of image forming device 100 is housed in a second replaceable unit. In another embodiment, developer unit 120 is provided with the main toner supply of image forming device 100 in a first replaceable unit and photoconductive drum 101 and cleaner unit 130 are provided in a second replaceable unit. Further, any other combination of replaceable units may be used as desired.

Figure 2:
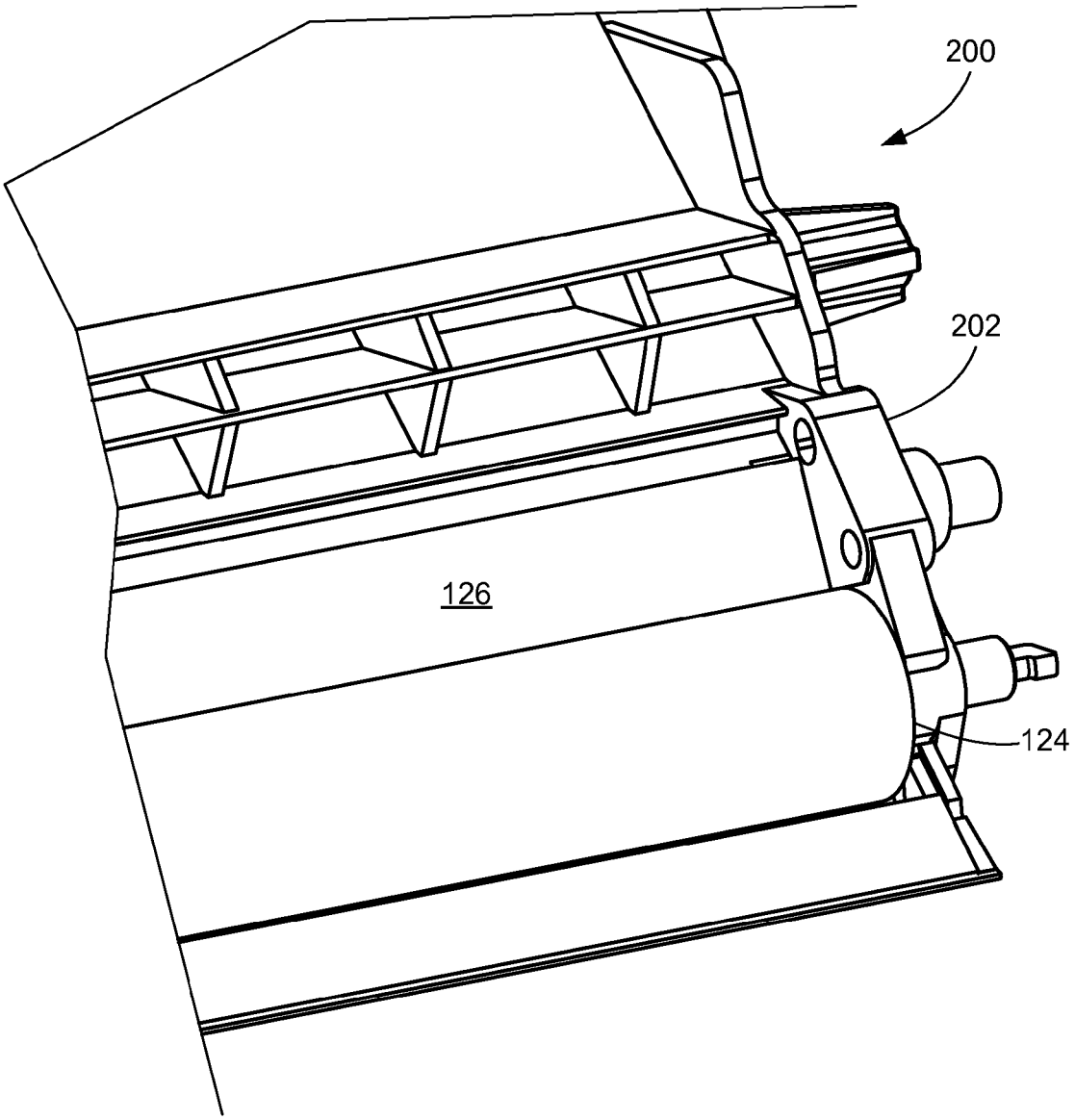
FIG. 2 is a perspective view of a portion of a replaceable unit of an electrophotographic image forming device according to one example embodiment.
Figure 3:
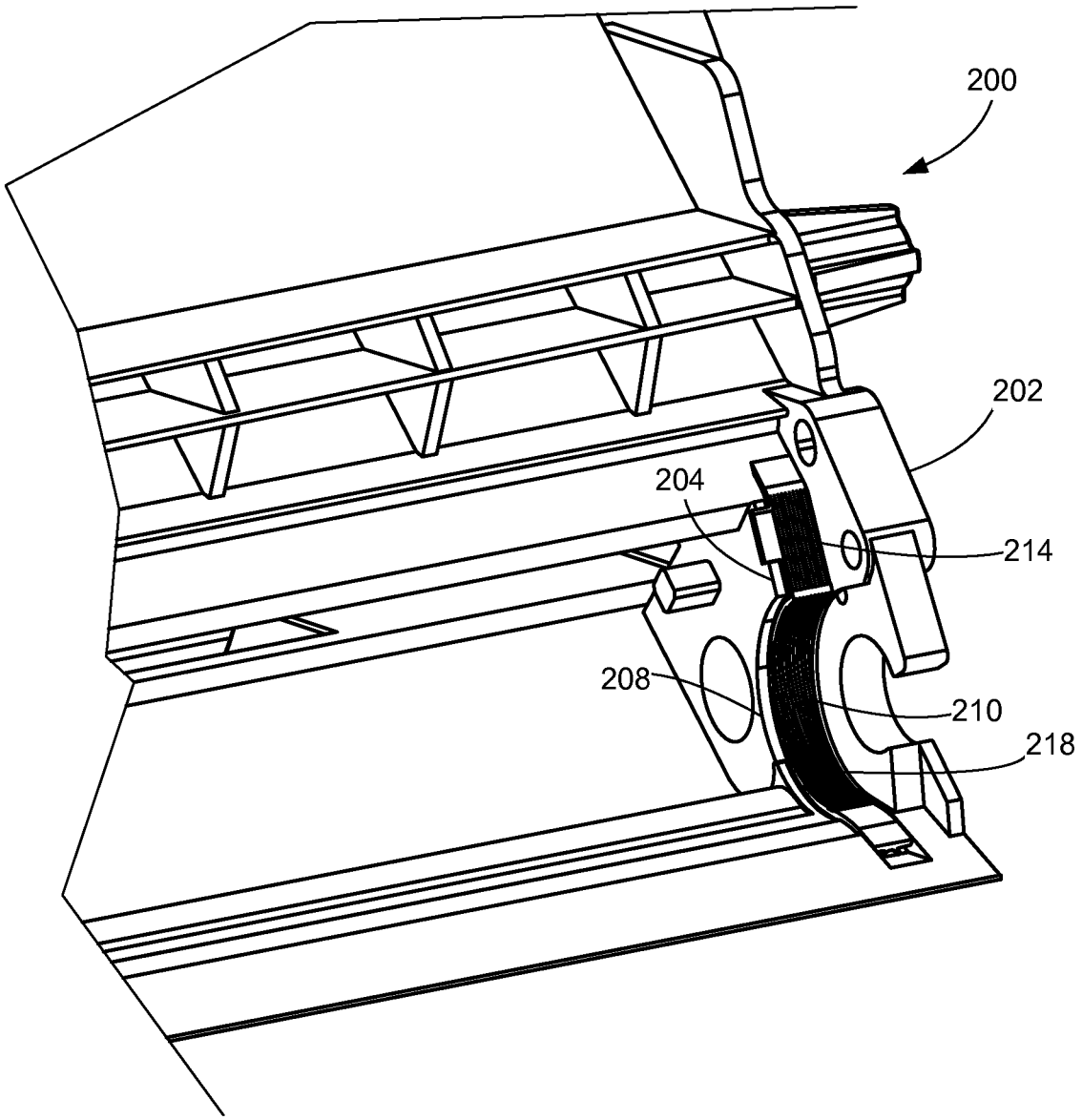
FIG. 3 is a perspective view of the replaceable unit shown in FIG. 2 with a developer roll and a doctor blade removed to show a sealing member according to one example embodiment.
Figure 4:
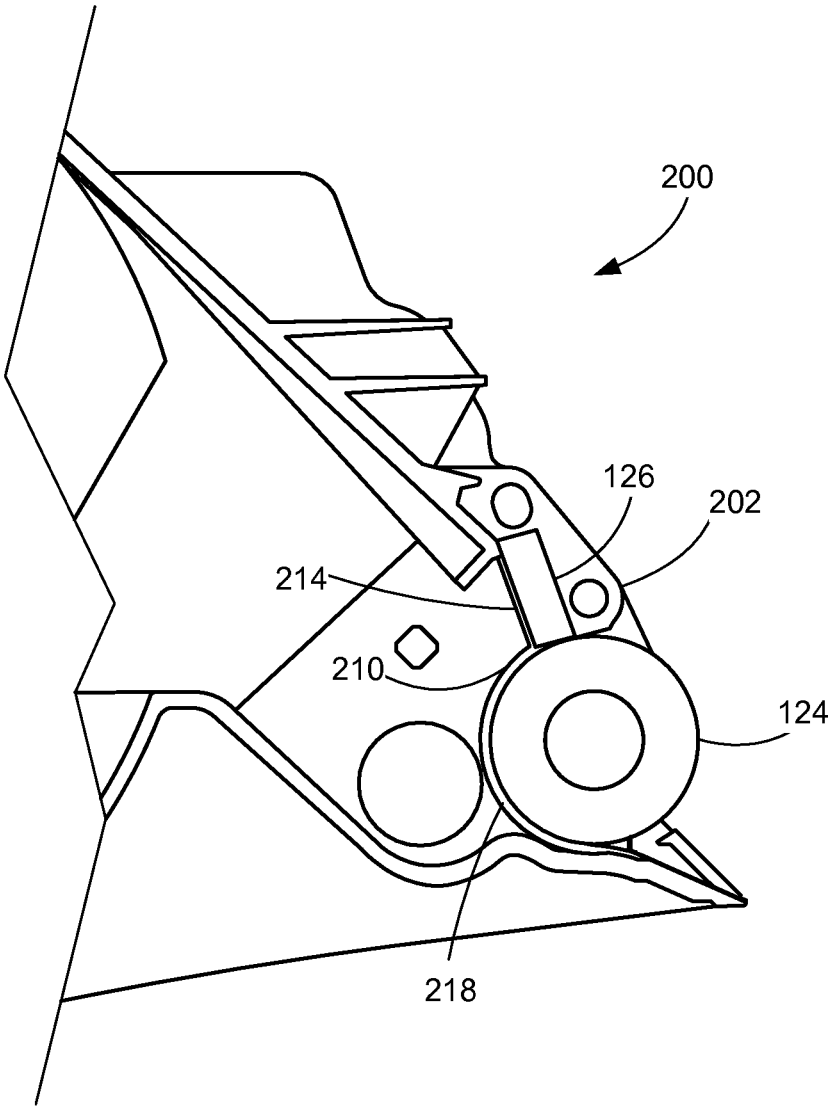
FIG. 4 is a sectional side view of the replaceable unit shown in FIGS. 2 and 3.

FIG. 2 illustrates an example replaceable unit 200 including a housing 202 containing developer roll 124 and doctor blade 126 positioned against developer roll 124. FIG. 3 shows replaceable unit 200 with developer roll 124 and doctor blade 126 removed to more clearly illustrate the internal components of replaceable unit 200. FIG. 3 shows an example sealing member 210 positioned in housing 202 at one axial end of developer roll 124. A second sealing member (not shown) is positioned at the opposite axial end of developer roll 124 and may be substantially the same as sealing member 210. A blade seal portion 214 of sealing member 210 is compressed between an interface 204 formed in housing 202 and an end portion of doctor blade 126 (FIG. 2). A rotary seal portion 218 of sealing member 210 is compressed between a curved interface 208 formed in housing 202 and an axial end portion of developer roll 124 (FIG. 2). FIG. 4 shows a side view of sealing member 210 in housing 202 positioned against developer roll 124 and doctor blade 126. As shown in FIG. 4, blade seal portion 214 of sealing member 210 is positioned against a rear surface of doctor blade 126 and rotary seal portion 218 of sealing member 210 is curved around and positioned against a rear surface of developer roll 124. Sealing member 210 may be described as J-shaped due to its substantially straight blade seal portion 214 and connecting curved rotary seal portion 218. Sealing member 210 prevents toner from leaking at the axial ends of developer roll 124 at the interface between housing 202, developer roll 124 and doctor blade 126.

Figure 5:
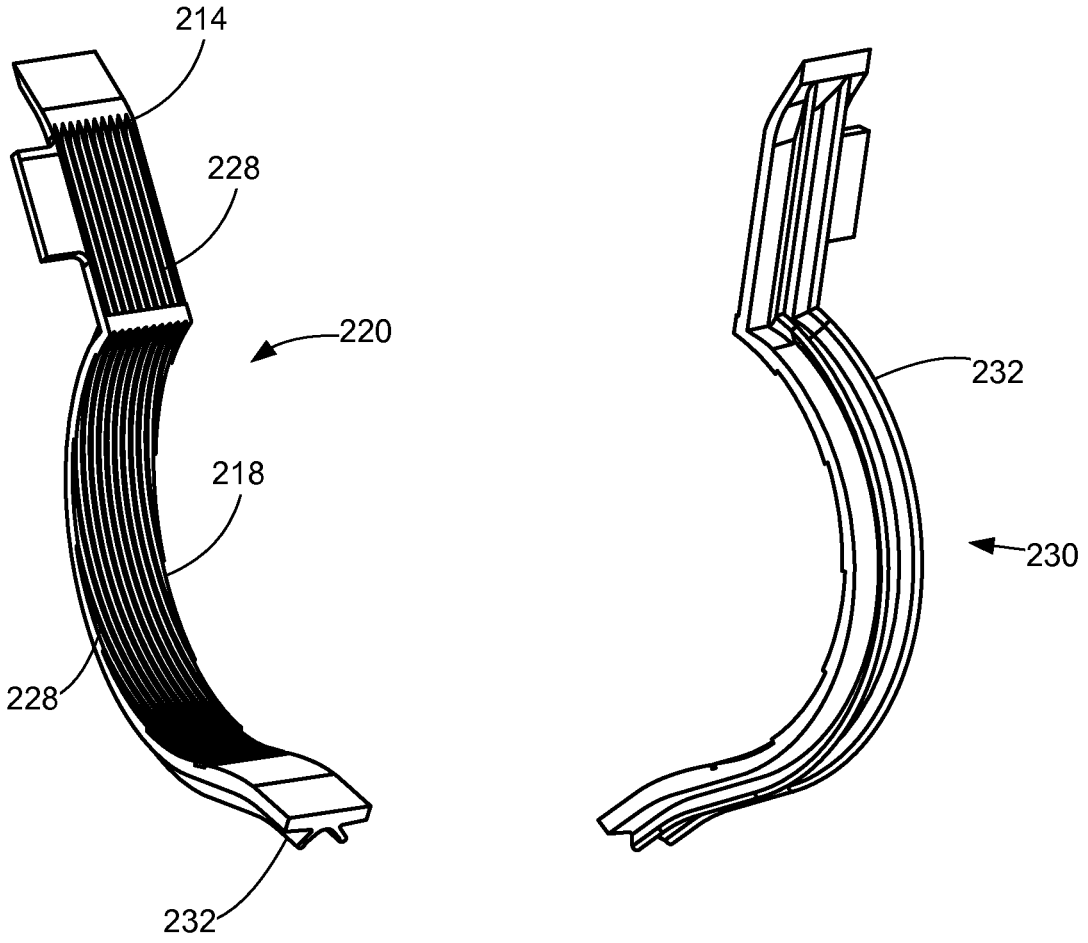
FIG. 5 includes front and rear perspective views of the sealing member shown in FIGS. 3 and 4.

FIG. 5 shows an example sealing member 210 in more detail. In this embodiment, a sealing face 220 of sealing member 210 includes grooves 228 therein to prevent the migration of toner past sealing member 210. Grooves 228 on sealing face 220 of rotary seal portion 218 may be angled to guide toner away from the axial end of developer roll 124. In the example embodiment illustrated, a rear face 230 of sealing member 210 includes one or more biasing ribs 232 which may run along all or a portion of rear face 230. Biasing ribs 232 bias sealing face 220 against doctor blade 126 and developer roll 124 to prevent toner leaks. Of course sealing member 210 may be any suitable shape as desired such as with or without grooves 228 and/or ribs 232.

Sealing member 210 includes a molded (e.g., injection molded or compression molded) body made of a polymeric elastomeric material having internal lubricant additives. One suitable example of an elastomeric material is SANTOPRENE™, a thermoplastic vulcanizate available from Exxon Mobil Corporation. The internal lubricant additives are present in the molded body at a relatively high loading, such as at least about 20% by weight of the molded body, and in some cases at least about 30% by weight of the molded body. This increased loading of lubricant additives results in more of the lubricant being at or near the surface of sealing member 210 where it can reduce the friction of sealing member 210. The internal lubricant additives include at least about 15% of a dry lubricant by weight of the molded body, at least about 5% of a wet lubricant by weight of the molded body, and at least about 3% rounded beads by weight of the molded body.

In one embodiment, the dry lubricant additive is tungsten disulfide. Other suitable dry lubricant additives include graphite, boron nitride, and polytetrafluoroethylene or combinations thereof (with or without tungsten disulfide). Polytetrafluoroethylene is commercially available as TEFLON® from E.I. du Pont de Nemours and Company (DuPont™). In one embodiment, the wet lubricant additive is silicone oil. Wet lubricants other than silicone oil may be used provided they do not adversely interact with the toner. In one embodiment, the rounded beads include solid and/or hollow glass microspheres which provide a durable bearing surface. The rounded beads may also include urethane beads, methyl methacrylate (MMA) beads, and/or TOSPRIL™ beads (available from Momentive Performance Materials, Inc.).

It will be appreciated that the maximum loading levels of the lubricant additives are limited by the molding requirements of sealing member 210, i.e., when the internal lubricant additives are loaded beyond a certain percentage, it will become difficult or impossible to form sealing member 210. For example, if too much silicone oil is used, the viscosity of the molten blend of elastomer material and lubricant additives used to form the sealing member will be too low. The loading levels of the lubricant additives are further limited by the hardness of sealing member 210. Specifically, it is desired that the durometer hardness of the seal not exceed 85 Shore A. It is believed that a durometer hardness of greater than 85 Shore A would increase the force between sealing member 210 and developer roll 124 enough to cause excessive frictional heating even with the increased lubricant additives. If too much dry lubricant or rounded beads are used, the seal hardness may be too high. Further, it is believed that if the particle size of the dry lubricant or the rounded beads exceeds 15 μm, defects large enough to generate toner leakage could occur on sealing face 220 of sealing member 210 if the particles became dislodged.

EXAMPLE

A J-shaped sealing member was formed by blending the elastomeric material SANTOPRENE™ with the following lubricant additives: about 20% of tungsten disulfide by weight of the molded body, about 7% of silicone oil by weight of the molded body, and about 5% of 10 μm glass beads by weight of the molded body. The blend was then extruded into pellets. The extruded pellets were molded into the J-shape of the sealing member. It will be appreciated that the lubricant additive loadings of this example sealing member are at significantly higher levels than the additives used in the prior seals discussed above, which used about 1% silicone oil and about 1% polytetrafluoroethylene. Despite the increased loadings, it was observed that the example sealing member possessed adequate wear resistance, compression, hardness and moldability.

As illustrated in Table 1 below, it was observed that combining the tungsten disulfide, silicone oil and glass bead additives, results in a lower coefficient of friction of the example sealing member than any one of the additives separately. Specifically, when combined, the silicone oil and tungsten disulfide provide a sealing member having a lower coefficient of friction than a comparable sealing member having either additive separately. The glass beads further enhance the lubricating effect of the tungsten disulfide and silicone oil. The coefficient of friction of a sealing member using the combined internal lubricant additives of the present example was also significantly lower than the prior seals discussed above using about 1% silicone oil and about 1% polytetrafluoroethylene. As a result of the decreased coefficient of friction, the force between the example sealing member and developer roll 124 may be about fifteen times greater than that of the prior seals without causing excessive frictional heating. The increased force between developer roll 124 and sealing member 210 improves the sealing ability of sealing member 210 especially at higher print speeds.

TABLE 1

| Internal Additives of the Sealing Member (by percent weight of the sealing member) | Coefficient of Friction of the Sealing Member |
|---|---|
| ~1% silicone oil + ~1% TEFLON ® | 0.9 |
| 20% tungsten disulfide | 0.69 |
| 7% silicone oil | 0.74 |
| 5% 10 μm glass beads | 0.79 |
| 20% tungsten disulfide + 7% silicone oil + 5% 10 μm glass beads | 0.45 |

Figure 6:
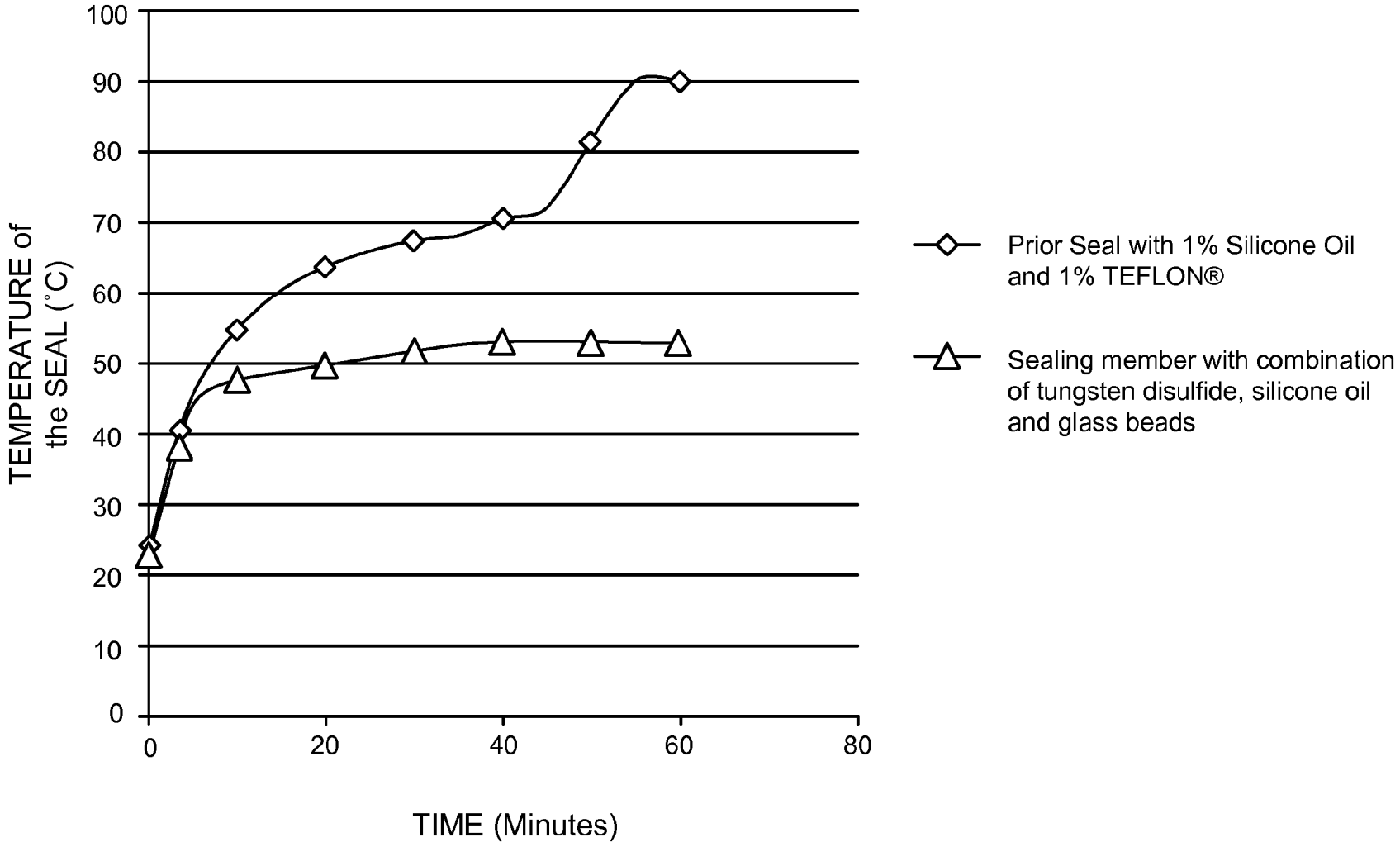
FIG. 6 is a graph comparing the performance of a sealing member according to one example embodiment with a prior seal showing the temperature of the seal versus time during a printing operation at 55 pages per minute.

As illustrated in FIG. 6, the example sealing member exhibited a decrease in the temperature of the J-shaped seal during printer operation at a relatively high rate of print speed (55 pages per minute) in comparison with the prior seals that included about 1% silicone oil and about 1% polytetrafluoroethylene)(TEFLON®).

Accordingly, the present disclosure includes the use of very high levels of internal lubricant additives (at least 20% by weight of the sealing member) and the combination of dry and wet lubricants with a hard rounded material to act as a bearing surface in a high friction elastomer sealing member. The internal lubricant additives decrease the friction between the sealing member and adjacent moving components thereby reducing frictional heating and extending the life of the sealing member and the moving components. Loadings of additives at these levels in an elastomer sealing member were previously considered too high to maintain flexibility and mechanical strength.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A sealing member for use in an electrophotographic image forming device, comprising:
- a molded body formed of an elastomer material and internal lubricant additives,
- wherein the lubricant additives comprise at least about 20% by weight of the molded body and include:
  - a wet lubricant;
  - a dry lubricant; and
  - rounded beads.

2. The sealing member of claim 1, wherein the lubricant additives comprise at least about 30% by weight of the molded body.

3. The sealing member of claim 1, wherein the lubricant additives include:
- at least about 15% of the dry lubricant by weight of the molded body;
- at least about 5% of the wet lubricant by weight of the molded body; and
- at least about 3% of the rounded beads by weight of the molded body.

4. The sealing member of claim 1, wherein the dry lubricant includes tungsten disulfide.

5. The sealing member of claim 1, wherein the dry lubricant includes at least one of graphite, boron nitride, and polytetrafluoroethylene.

6. The sealing member of claim 1, wherein the wet lubricant includes silicone oil.

7. The sealing member of claim 1, wherein the rounded beads include glass beads.

8. The sealing member of claim 1, wherein the dry lubricant and the rounded beads have a particle size no greater than about 15 μm.

9. The sealing member of claim 1, wherein a shore hardness of the sealing member is no greater than about 85 Shore A.

10. The sealing member of claim 1, wherein the sealing member is a J-shaped seal for sealing an interface between a developer roll, a doctor blade positioned against the developer roll and a housing containing the developer roll and the doctor blade.

11. A replaceable unit for use in the electrophotographic image forming device including the sealing member of claim 10.

12. A sealing member for use in an electrophotographic image forming device, comprising:
- a molded body formed of an elastomer material and internal lubricant additives,
- wherein the lubricant additives include:
  - at least about 15% tungsten disulfide by weight of the molded body;
  - at least about 5% silicone oil by weight of the molded body; and
  - at least about 3% glass beads by weight of the molded body.

13. The sealing member of claim 12, wherein the lubricant additives include:

about 20% of the tungsten disulfide by weight of the molded body;

about 7% of the silicone oil by weight of the molded body; and about 5% of the glass beads by weight of the molded body.

14. The sealing member of claim 12, wherein the tungsten disulfide and the glass beads have a particle size no greater than about 15 μm.

15. The sealing member of claim 12, wherein the glass beads have a size of about 10 μm.

16. The sealing member of claim 12, wherein a shore hardness of the sealing member is no greater than about 85 Shore A.

* * * * *